US005671001A

United States Patent [19]

Elliot et al.

[11] Patent Number: 5,671,001

[45] Date of Patent: Sep. 23, 1997

[54] LEAK RESISTANT INK CONTAINMENT FOR A PRINTER

[75] Inventors: Joseph R. Elliot, Corvallis; J. Paul Harmon, Albany; Naoto Kawamura; John M. Altendorf, both of Corvallis, all of Oreg.

[73] Assignee: Hewlett-Packard Company, Palo Alto, Calif.

[21] Appl. No.: 397,823

[22] Filed: Mar. 3, 1995

[51] Int. Cl.[6] ..... B41J 2/175

[52] U.S. Cl. ..... 347/87

[58] Field of Search ..... 347/87, 86, 92, 347/84, 85

[56] References Cited

U.S. PATENT DOCUMENTS

| | | | |
|---|---|---|---|
| 5,025,271 | 6/1991 | Baker et al. | 346/140 |
| 5,047,790 | 9/1991 | Cowger et al. | 346/140 |
| 5,280,299 | 1/1994 | Saikawa et al. | 347/87 |

FOREIGN PATENT DOCUMENTS

| | | | |
|---|---|---|---|
| 0419192A1 | 9/1990 | European Pat. Off. | B41J 2/175 |
| 0624475A2 | 5/1994 | European Pat. Off. | B41J 2/175 |
| 0633138 | 7/1994 | European Pat. Off. | G41J 2/175 |

*Primary Examiner*—Benjamin R. Fuller
*Assistant Examiner*—Judy Nguyen
*Attorney, Agent, or Firm*—Raymond A. Jenski

[57] ABSTRACT

In order that ink leakage be reduced from a compressed foam storage ink container for an inkjet printer cartridge, at least one of the walls of the container is provided relief pockets having air spaces free of the compressed foam. At least one vent channel communicates between relief pockets and ambient air pressure to provide pressure equilibrium.

13 Claims, 6 Drawing Sheets

LEAK RESISTANT INK CONTAINMENT FOR A PRINTER

This invention generally relates to an ink container for a printer and more specifically relates to a foam-based ink containment system useful in an inkjet printer print cartridge.

BACKGROUND OF THE INVENTION

Printers have become well known elements of a computing system and provide the means by which computer information may be output to tangible forms such as characters or images on a medium like paper or transparency film. A key component of a printer is the print cartridge, a device which converts the electrical signals output from the computer system to ejections of small droplets of ink particularly timed and placed so that desired characters or images may be created upon the medium from the small droplets of ink. One constituent element of a print cartridge is a laminate structure of a substrate, a photodefinable layer, and a perforated layer. This laminate structure is generally known as a printhead. In a thermal inkjet printhead, one will typically find a plurality of nearly microscopic resistive heaters in the substrate for heating small chambers containing ink. A small nozzle or orifice in the perforated layer is associated with the small ink chamber and enables the ink droplet to be ejected when the heater resistor is activated and the ink is vaporized. Feeding each of the miniature ink chambers is a series of tubes or channels which bring ink from a larger ink reservoir to the small ink firing chambers. It can be readily apprehended that some control over the flow of ink must be maintained so that the proper amount of ink reaches each of the small ink firing chambers but not so much ink is delivered so that ink leaks, or drools, from the orifices in the printhead. It is well known that a slight negative pressure, a backpressure, is maintained in the ink cartridge to prevent drool from the printhead.

If color printing is to be achieved, multiple colors must be made available to the printer. In many implementations, several colors, usually three, are contained within one print cartridge. Three separate ink containment systems and ink delivery systems are coupled to three separate groups of ink firing chambers and orifi. In order to achieve high quality, high resolution printing these groups of orifi are placed relatively close together on the print cartridge printhead. One of the problems which may develop from a print cartridge which drools, is the leakage of one color ink from one color group of orifi onto the surface of the printhead due to ambient conditions such as temperature change or atmospheric pressure change. Since there are three groups of orifi corresponding to each of the three colors, it is possible that one of the colors of ink will drool from its associated set of orifi, migrate across the surface of the printhead to another color group of orifi and, when the temperature or pressure again changes, the one color droplet is sucked back into the orifi of another color ink. The mixing of these two ink colors creates a contaminated color which, upon printing, produces a poor quality color image. Extended cycles of drooling and reabsorbtion can ruin an entire print cartridge resulting in its early, and undesired, replacement.

In a conventional implementation to provide the desired back pressure, a porous member of foam is disposed in the ink containment cavity of a print cartridge. The foam is conventionally a controlled porosity material having an extensive network of pores and capillaries in which the ink for use by the print cartridge is stored. The foam is also compressed by the walls of the ink containment portion of the print cartridge so that the capillary force of the foam will be increased—particularly in the areas of greatest foam compression. See, for example, U.S. Pat. No. 5,025,271, "Thin Film Resistor Type Thermal Ink Pen Using a Foam Storage Ink Supply."

Causes of ink drool have been related to trapped air bubbles within the ink containment device of a print cartridge. One technique of reducing ink drool in a print cartridge has been addressed in U.S. patent application Ser. No. 08/075,357 "Leak Resistant Ink-Jet Pen", filed Jun. 9, 1993, on behalf of Melissa D. Boyd et al. There, a relatively large bubble of air trapped in the ink conduits from the ink storage area to the printhead has been found to be overcome by providing collateral paths for the ink to flow around a trapped bubble. In some instances, however, trapped air may not take the form of a single large bubble but may in fact be a large number of small bubbles distributed throughout the foam of an ink containment device. Although each bubble itself may be small, the overall effect of a large number of such bubbles, especially when subjected to variations in temperature and atmospheric pressure, will be to grow in volume and displace an equivalent volume of ink. If the ink has no other path to follow, it will be pushed out of the orifices of the printhead causing the undesired drool.

SUMMARY OF THE INVENTION

An ink container for an inkjet print cartridge has an ink inlet disposed near a first end of the ink container. First and second opposing walls are disposed between the first end and a second end of the ink container and a porous member, extending from the first end towards the second end, is disposed between and is compressed by the first and second opposing walls. A plurality of relief pockets are disposed in a surface of the first wall and each relief pocket has a bottom which is recessed from the surface of the first wall by a depth such that the compressed porous member does not follow the contour of the relief pocket. At least one vent channel communicates with at least a portion of the plurality of relief pockets and extends in a direction from the first end toward the second end.

DETAILED DESCRIPTION OF A PREFERRED EMBODIMENT

Figure 1:
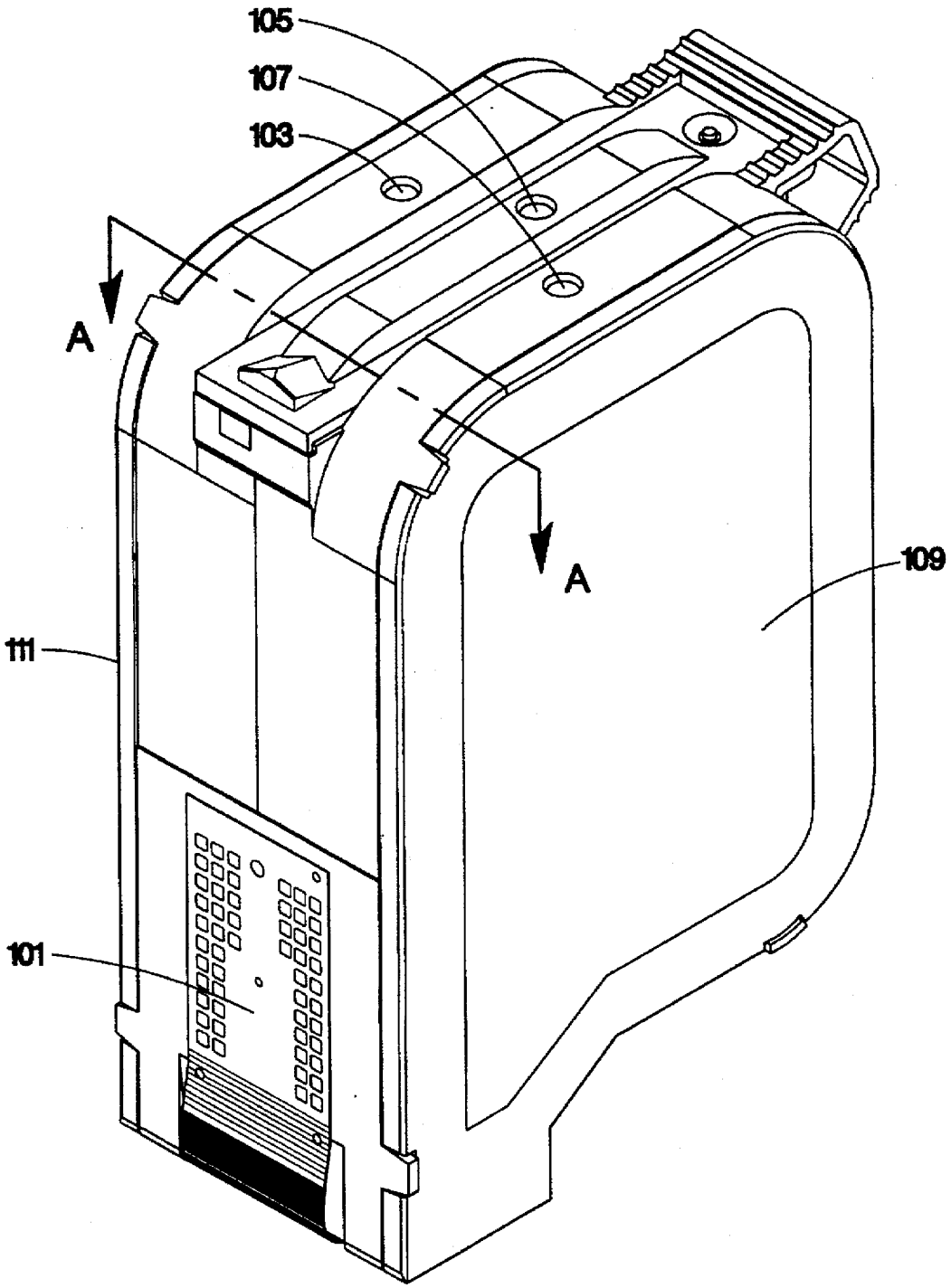
FIG. 1 is an isometric view of a print cartridge which may employ the present invention.

A print cartridge which may employ the present invention is shown in FIG. 1. This print cartridge contains three colors of ink, cyan, yellow, and magenta, each color housed or contained in a separate ink container within the housing of the print cartridge. Not visible in the isometric view in FIG. 1 but oriented down in this particular view, is the printhead. In the preferred embodiment, the printhead has three groups of orifi and their associated ink firing chambers and heater resistors disposed on and in a printhead substrate. Each group is coupled to an associated ink container so that ink may be supplied as needed to the printhead. Electrical commands to the printhead are coupled to the print cartridge by way of a plurality of electrical contacts on a flexible circuit 101.

During manufacture, each color of ink is introduced into the proper ink container for that color ink by way of ink fill holes 103, 105, and 107. Following the filling of each of the ink containers with its proper colored ink, the fill holes 103, 105, and 107 are plugged—but not entirely cut off from atmospheric pressure. A vent plug having a small or serpentine opening in it can plug each ink fill hole to prevent the escape of ink. This type of vent plug allows equalization of the air pressure within the ink container to the outside air pressure as ink is consumed. It also reduces disequilibrium caused by changes in temperature or by changes in air pressure such as might be experienced with weather systems or changes in altitude of the entire printer itself. On each side of the print cartridge of FIG. 1 there is a side cover (109, 111) each of which forms a respective wall of one of the ink containers within the print cartridge.

Figure 2:
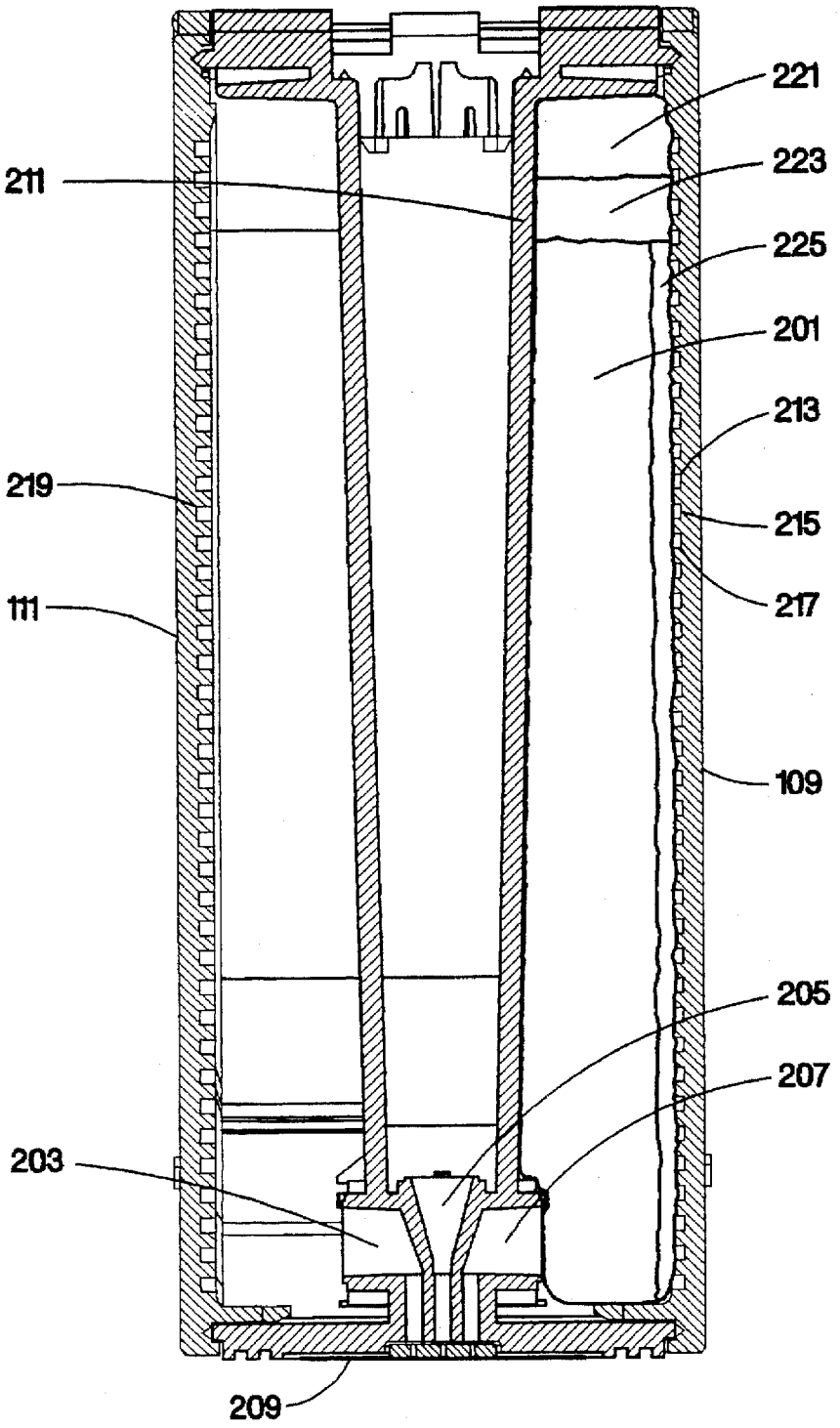
FIG. 2 is a cross section (designated A—A) of the print cartridge of FIG. 1.

A cross section of the print cartridge of FIG. 1 through each of the ink containers is shown in FIG. 2. The orientation between the two drawings is preserved; that is, the ink fill holes 103, 105, and 107 are located at the top of the print cartridge (as shown) and ink outlets 203, 205, and 207 are located at the bottom of the print cartridge. A foam porous member 201 is shown in the right (yellow) ink container. For clarity of understanding, the foam porous member has been deleted from the view of the center (magenta) ink container and from the left (cyan) ink container. In the preferred embodiment, each of the ink container sections has a foam porous member disposed in it and extending from the end of the ink container at which the ink outlet (203, 205, and 207) is found. Each color ink outlet is fluidically coupled to its associated firing chamber and orifi of the printhead 209. In the preferred embodiment, the foam extends from the ink outlet end of the ink container to the opposite end of the ink container. The foam porous member 201 is not filled to the top with ink. There is a zone 221 of foam at the top of each ink container of the print cartridge closest to the ink fill hole which does not contain ink and which, due to the slight hydrophobic nature of the foam, is not wetted by the ink (a "dry zone"). At the interface between the air and the ink there is a zone 223 of wetted foam (a "damp zone") which is not saturated with ink but provides a capillary pressure which attracts the ink and provides backpressure for the print cartridge.

When each of the ink containers are filled with ink, the ink is forced into the foam porous member (e.g. 201). It is forced into the foam at a relatively high rate, for example, over a period of one to two seconds. Any gaps which reach the top of the ink container between walls and the foam can result in the ink flowing back through the relatively low fluid resistance of this gap to the ink fill opening and out the ink fill opening without properly entering and wetting the foam porous member. Thus, the foam porous member must be carefully placed within the ink container and compressed between the walls of the ink container. Extended vertical ribs, such as those used in BCI-21 ink cartridge available from Canon, would allow ink to flow back to the fill holes of the present invention. Viewing the right side ink container of the print cartridge of FIG. 2, it can be seen that the foam porous member 201 is compressed between the inside wall 211 and the outside wall 109. A similar foam installation and compression is found in the left side ink container portion of the printhead of FIG. 2. The foam of the center ink container is carefully inserted and is also compressed by the walls of its associated ink container.

It will be observed that the left and right side ink containers of the print cartridge of FIG. 2 have a converging geometry of the inner and outer walls of the container. As shown in FIG. 2 this convergence is realized, for example in the right side ink container with a wider separation between the walls 211, 109 at the bottom end of the ink container closest to the ink outlet 207 and a narrower space between the walls at the end of the ink cartridge which is closest to the ink fill hole (and, after the ink fill hole is plugged, the atmospheric vent). There is also local compression of the foam in the area of the ink outlets 203, 205, 207. The center (magenta) ink container has an opposite wall convergence, that is, a narrower separation between the walls at the bottom near the ink outlet 205 and a wider separation of the walls at the ink fill and atmospheric vent end at the top of the ink container. The convergent geometry at the atmospheric vent offers several advantages, among them a convenient draft angle for the plastic mold and an improved backpressure characteristic for the right and left ink containers of the print cartridge.

It is known that, within certain limits, compression of a porous foam results in a higher capillary pressure at the areas of higher compression. In the preferred embodiment, the foam used is a felted urethane material having a porosity of approximately 50 pores per centimeter. A conventional foam compression design is similar to that which is found in the center (magenta) ink container that is, a greater compression of foam by the walls at the ink outlet end so that ink is drawn to the ink outlet by capillary action throughout the foam porous member. It has been determined, however, that reversing the foam compression geometry to an extent so that the greater compression is found at the end of ink container which is opposite the ink outlet results in a better and more predictable back pressure characteristic as ink is withdrawn from the ink container. Such a configuration is further described in U.S. patent application Ser. No. 08/331,847 "Ink-Jet Pen with Capillarity Gradient" filed on Oct. 31, 1994, on behalf of John Altendorf.

When less viscous inks are used and when a greater ink fluid head is found, the compression geometry of the right and left side ink containers can produce a greater magnitude of drool than that produced in the center ink container. Since the ink in a print cartridge which has been filled is attracted to the higher compression end of the foam porous material, a greater ink concentration is produced at that end of the foam porous member. Air bubbles which are trapped in the pores of the foam porous member will expand with increasing temperature or with reduced atmospheric pressure. When the trapped air bubbles expand, ink is displaced and must find an outlet for its displacement. Ink displaced by the expanding air bubbles is reluctant to move into the dry zone, due to its hydrophobic nature. However, the ink will move into the damp zone due to its higher capillary forces until a saturated layer forms at the boundary with the dry zone. Backpressure is maintained until the saturated layer isolates the trapped air from the vent. Further expansion of air causes an increase in pressure which results in the forcing of ink through the ink outlets and out of the printhead orifi. The result is an ink drool out of the printhead.

Figure 3:
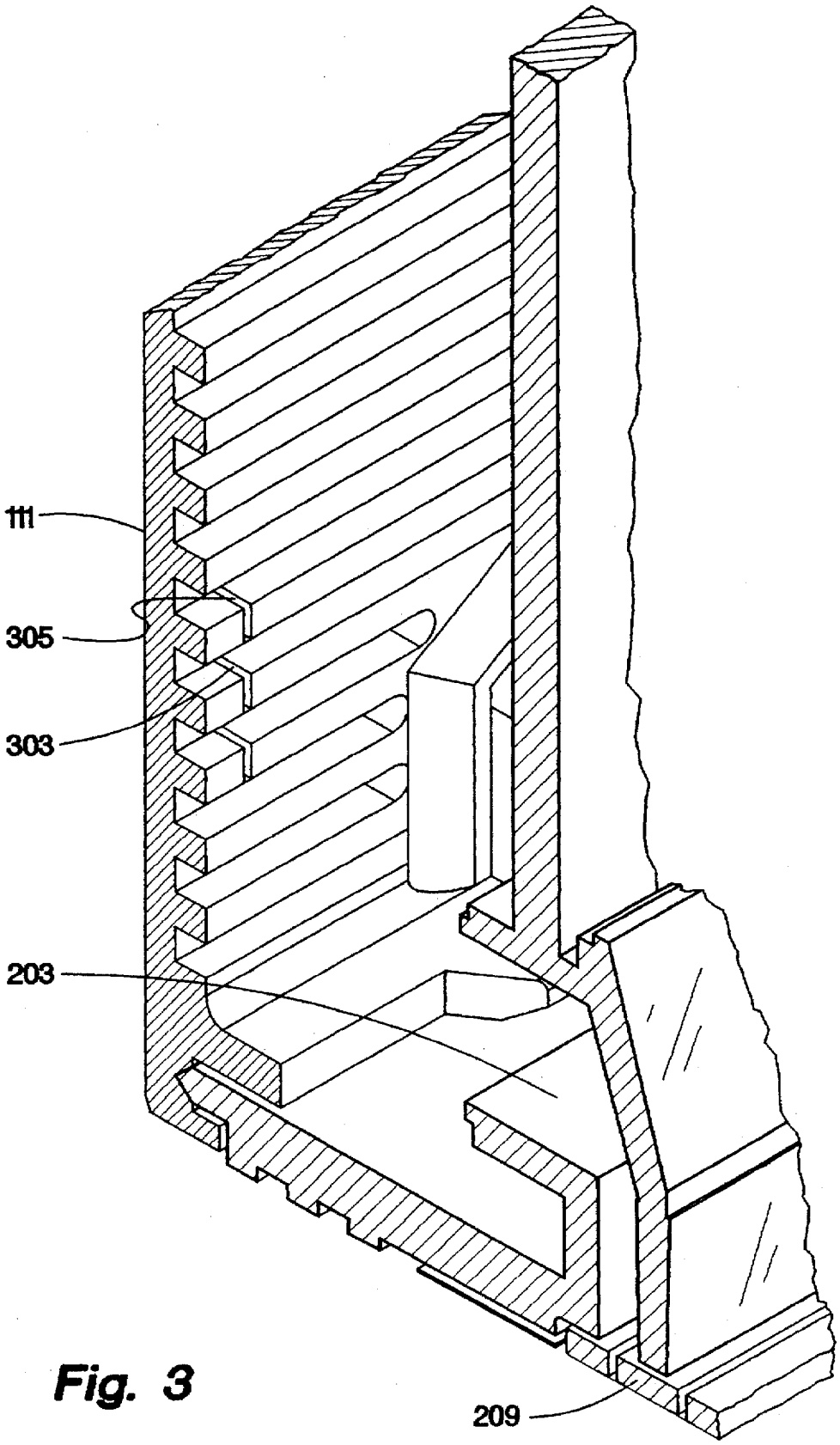
FIG. 3 is an enlargement of one portion of the cross section of FIG. 2, shown in perspective.

To resolve this difficulty, a number of relief pockets (213, 215, 217, and 219) are created on the inside surface of the outer walls 109, 111 of the right and left side ink containers of the printhead as shown in FIG. 2. An enlarged isometric view of the left bottom and of the left side ink container is shown in FIG. 3. In a preferred embodiment of the present invention, a series of slots running across the inner surface of wall 111 are molded into the inner surface of wall 111. In the preferred embodiment, 36 slots are molded into the wall, each slot 1 mm wide and 1 mm or less deep. The spacing between each of the relief pocket slots is 1 mm. Although the slots are shown perpendicular to the line between the atmospheric vent and the lower surface near the ink outlet, an angle less than 90° can be tolerated as long as the relief pockets do not provide an extended vertical series of slots which causes ink to easily flow back to the ink fill hole when the ink container is being filled with ink.

Figure 4:
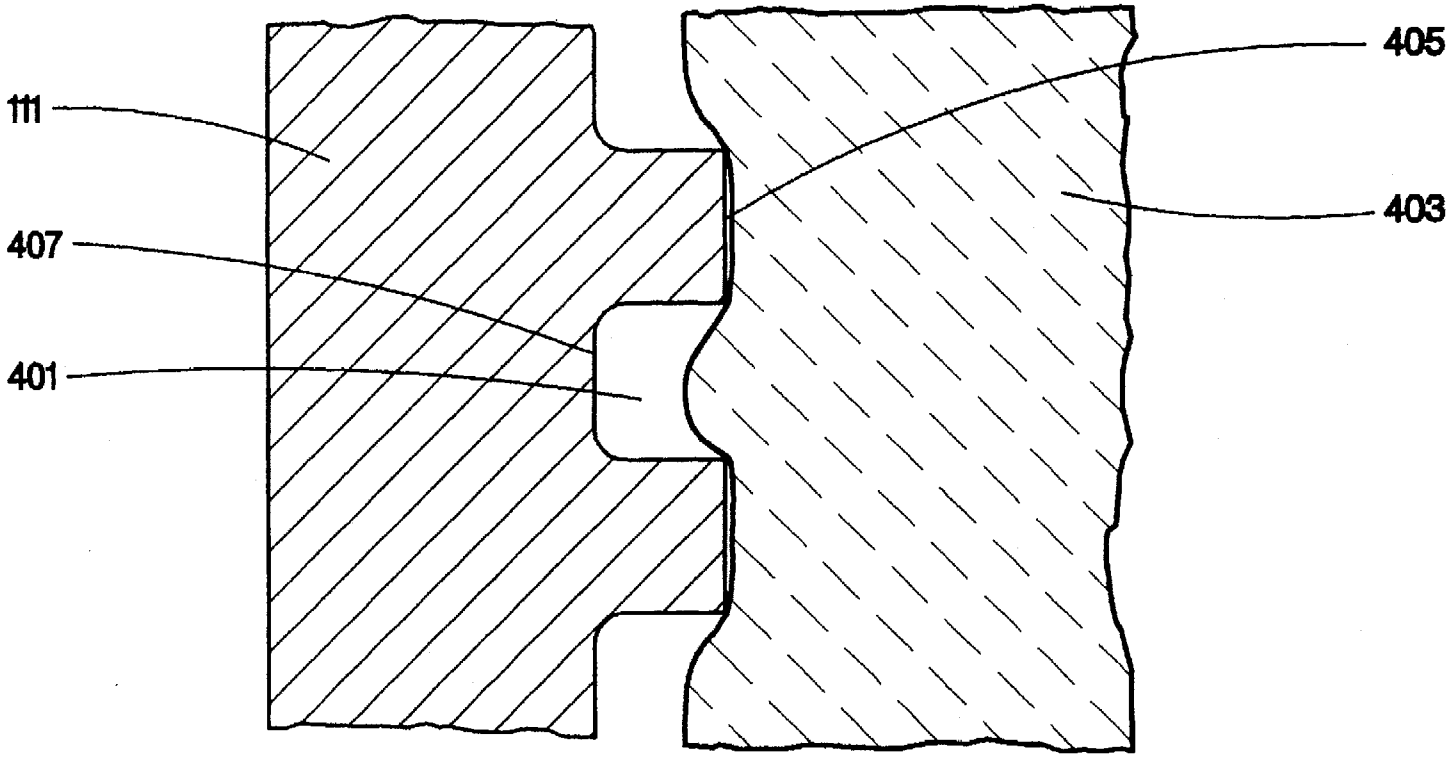
FIG. 4 is a cross section of a wall and foam porous member which may be employed in the present invention.

A cross section of a relief pocket 401 useful in the present invention is shown in FIG. 4. It is a feature of the present invention that the foam porous member 403 is compressed by the inner surface 405 of the wall 111 but does not follow the contour of the relief pocket and is generally prevented from contacting the bottom 407 of the relief pocket. Thus, a volume of air external to the foam porous member is created within each relief pocket.

Figure 5:
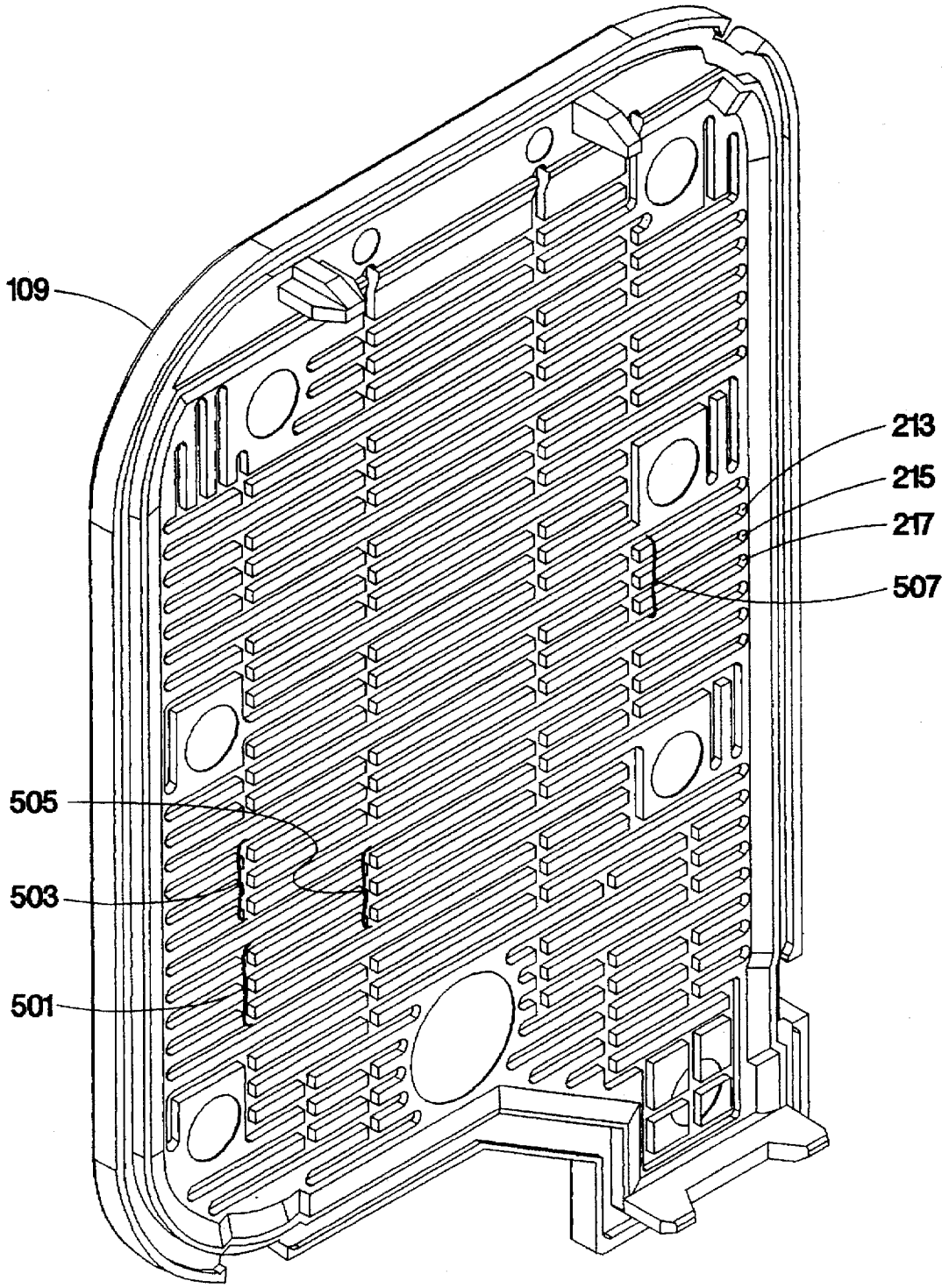
FIG. 5 is an isometric view of a print cartridge wall illustrating relief pockets and vent channels and which may be employed in the present invention.

Returning again to FIG. 3, it can be seen that a plurality of slots 303, 305 communicate between some of the relief pockets. Referring now to the view of one wall of the print cartridge shown in FIG. 5, it can be seen that the inside surface of wall 109 has provided therein, preferably by molding, the plurality of relief pockets (for example, 213, 215, and 217) which, in the preferred embodiment, are slots. Groups of slots, which considered together form a vent channel, are oriented perpendicular to the relief pockets and are formed on the inner surface of wall 109. These groups are identified as vent channels 501, 503, and 505. It can be seen that vent channel 507 couples the relief pockets 213, 215, and 217 so that air may be exchanged between them. A path is formed of a plurality of vent channels to couple all of the relief pockets to the dry zone in the upper portions of the ink container and eventually to the atmospheric vent 107. The structure of the relief pockets and the interconnecting vent channels allows air to move between external air and along a surface of the foam. Referring again to FIG. 2, the effect of this communication of ambient air to the relief pockets is to provide an extended damp zone 225 in the porous material 201 along the inner surface of the wall 109. Thus when ink is displaced by the environmentally induced expansion of small air bubbles trapped in the ink containing foam porous member, it is drawn into the damp zones 225, 223 (which favor such migration). The balance of forces acting upon the ink thus remain in equilibrium even during environmental changes and the backpressure of the foam continues to prevent drool from the printhead orifi. Simply stated, the relief pockets of the present invention increase the mount of damp zone air/ink interface and provide some of such increased damp zone interface at areas of the foam which are not at the greatest compression. Of course, when the trapped air bubbles within the foam porous member reduce in size, ink replaces the shrunken bubble volume from the damp zone and the equilibrium of air pressure is maintained by way of the atmospheric vent plug, the vent channels, and the relief pockets. In the preferred embodiment, the vent channels are 1 mm wide and 0.7 mm deep.

Figure 6:
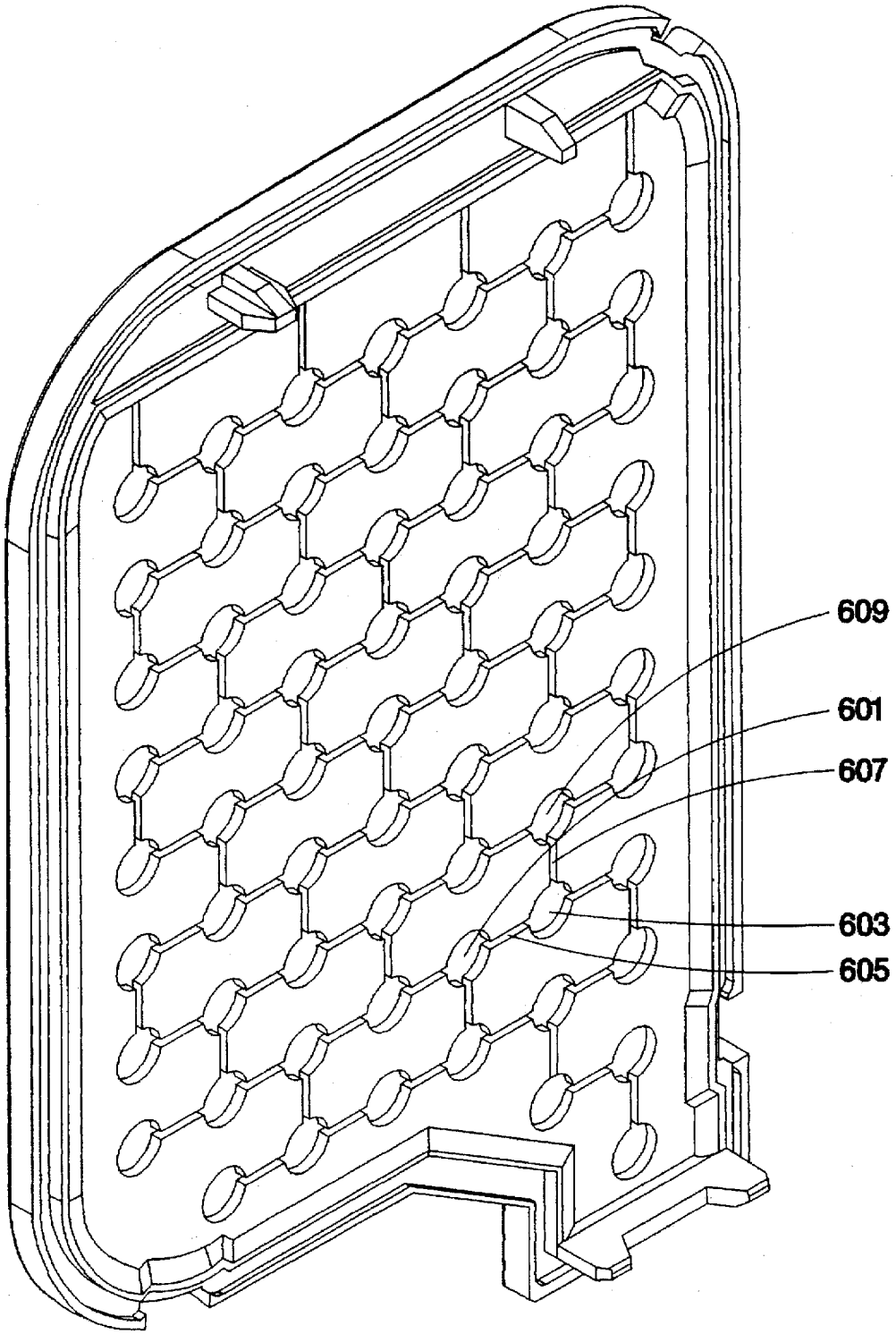
FIG. 6 is an isometric view of an alternative embodiment of a print cartridge wall illustrating relief pockets and vent channels and which may be employed in the present invention.

An alternative design of relief pockets is shown in FIG. 6. In this alternative embodiment, 65 circular depressions having a 4 mm. diameter and a 1 mm. or less depth are molded into the side wall of the ink container. Each relief pocket, for example 601, is fluidically coupled to a second relief pocket 603 by way of a 0.7 mm. wide slot 605. Between neighboring relief pockets, a vertical slot or vent channel 607 couples the relief pockets (for example, relief pocket 603 and 609) and provides the outlet to the atmospheric vent at the top of the ink container. Spacing between the outer circumference of each of the relief pockets is 3 mm.

We claim:

1. An ink container for an inkjet cartridge comprising:

an ink inlet disposed near a first end of the ink container;

a first wall and a second wall disposed opposite each other and said first wall and said second opposing wall extending between said first end and a second end of the ink container;

a porous member disposed between and compressed by said first wall and said second opposing wall and extending from said first end towards said second end;

a plurality of relief pockets each comprising a slot disposed essentially perpendicular to a direction from said first end to said second end and disposed in a surface of said first wall, each of said relief pockets having a bottom which is recessed from said surface of said first wall by a depth such that said compressed porous member does not touch said bottom in substantially all of said plurality of relief pockets; and at least one vent channel communicating with at least a portion of said plurality of relief pockets and extending essentially in said direction from said first end toward said second end.

2. An ink container in accordance with claim 1 wherein said ink inlet further comprises an atmospheric vent and wherein said at least one vent channel is coupled to said atmospheric vent.

3. An ink container in accordance with claim 1 wherein said first wall and said second wall converge to a narrow separation at said first end near said ink inlet from a wide separation at said second end of the ink container.

4. A method of reducing ink leakage from an ink container for an inkjet print cartridge comprising the steps of:

disposing a first wall and a second wall of the ink container opposite each other and extending between a first end of the ink container having an ink inlet and a second end of the ink container;

compressing a porous member between said first wall and second opposing wall of the ink container;

providing a plurality of relief pockets offering fluid communication substantially perpendicular to a direction from said first end to said second end in a surface of said first wall;

recessing a bottom of each of said relief pockets from said surface of said first wall to a depth such that said compressed porous member does not touch said bottom in substantially all of said plurality of relief pockets; and coupling at least a portion of said plurality of relief pockets with a vent channel whereby air will move between said relief pockets and said vent channel.

5. A method in accordance with the method of claim 4 further comprising the step of coupling said vent channel to said ink inlet.

6. A method in accordance with the method of claim 4 further comprising the step of sloping said first wall and said opposing second wall towards each other whereby said first wall and said second wall converge toward each other in a direction toward said vent channel.

7. An ink container for an inkjet cartridge comprising:

an ink inlet disposed near a first end of the ink container;

a first wall and a second wall disposed opposite each other and said first wall and said second opposing wall extending between said first end and a second end of the ink container;

a porous member disposed between and compressed by said first wall and said second opposing wall and extending from said first end towards said second end;

a plurality of relief pockets disposed in a surface of said first wall, each of said relief pockets comprising a first depression coupled to a second neighboring depression by a slot oriented essentially perpendicular to a direction from said first end to said second end and disposed in said surface of said first wall, each of said relief pockets having a bottom which is recessed from said surface of said first wall by a depth such that said compressed porous member does not touch said bottom in substantially all of said plurality of relief pockets; and at least one vent channel communicating with at least a portion of said plurality of relief pockets and extending essentially in said direction from said first end toward said second end.

8. An ink container in accordance with claim 7 wherein said ink inlet further comprises an atmospheric vent and wherein said at least one vent channel is coupled to said atmospheric vent.

9. An ink container in accordance with claim 7 wherein said first wall and said opposing second wall converge to a narrow separation at said first end near said ink inlet from a wide separation at said second end of the ink container.

10. An ink container for an inkjet print cartridge comprising:

an ink inlet disposed near a first end of the ink container;

a first wall and a second wall disposed opposite each other and said first wall and said second opposing wall extending between said first end and a second end of the ink container;

a porous member disposed between and compressed by said first wall and said second opposing wall and extending from said first end towards said second end;

a plurality of relief pockets disposed in a surface of said first wall and each of said relief pockets having a bottom which is recessed from said surface of said first wall by a depth such that said compressed porous member does not touch said bottom in substantially all of said plurality of relief pockets; and a plurality of vent channel portions connecting at least some of said plurality of relief pockets such that no direct vertical connection between said first end and second end of said ink container is formed.

11. An ink container in accordance with claim 10 wherein said plurality of relief pockets each further comprise a slot disposed essentially perpendicular to a direction from said first end to said second end.

12. An ink container in accordance with claim 10 wherein said ink inlet further comprises an atmospheric vent:

wherein some of said plurality of vent channel portions and some of said plurality of relief pockets form a vent channel; and wherein said vent channel is coupled to said atmospheric vent.

13. An ink container in accordance with claim 10 wherein said first wall and said opposing second wall converge to a narrow separation at said first end near said ink inlet from a wide separation at said second end of the ink container.

* * * * *